United States Patent [19]

Syme

[11] 4,221,207

[45] Sep. 9, 1980

[54] HEATING APPARATUS HAVING IMPROVED COMBUSTION

[75] Inventor: Duncan C. Syme, Chelsea, Vt.

[73] Assignee: Vermont Castings, Inc., Randolph, Vt.

[21] Appl. No.: 46,326

[22] Filed: Jun. 7, 1979

Related U.S. Application Data

[63] Continuation of Ser. No. 837,608, Sep. 28, 1977, abandoned.

[51] Int. Cl.³ ..... F24C 1/14; F24C 15/28

[52] U.S. Cl. ..... 126/77; 126/83

[58] Field of Search ..... 126/77, 15, 16, 31, 126/39 J, 319, 314, 83, 112, 60, 62

[56] References Cited

U.S. PATENT DOCUMENTS

| | | | |
|---|---|---|---|
| 105,304 | 4/1917 | Larkin . | |
| 255,767 | 4/1882 | Burchfield | 126/15 R |
| 897,717 | 9/1908 | Culver | 126/319 |
| 921,019 | 5/1909 | Speer | 126/83 |
| 1,321,676 | 11/1919 | Shurtleff | 126/314 |
| 1,802,418 | 4/1931 | Flaherty | 126/314 |
| 2,066,997 | 12/1953 | Chesser | 126/15 R |
| 2,177,824 | 10/1939 | George | 126/65 |
| 2,967,522 | 1/1961 | Takahashi | 126/77 |
| 3,168,088 | 2/1965 | Martin et al. | 126/77 |
| 3,715,550 | 2/1973 | Harnden, Jr. et al. | 126/39 J |
| 3,993,040 | 11/1976 | Antone | 126/58 |
| 4,078,541 | 3/1978 | Roycraft | 126/112 |

OTHER PUBLICATIONS

Defiant Parlor Stove, pp. 3-15.

*Primary Examiner*—Samuel Scott
*Assistant Examiner*—Wesley S. Ratliff, Jr.
*Attorney, Agent, or Firm*—Kenway & Jenney

[57] ABSTRACT

A wood-burning heating apparatus, used as a parlor stove, and providing a significant heat output is disclosed. The stove has primary and secondary combustion chambers and a baffling arrangement for directing flue gases along a circuitous path to the exit aperture whereby a significant proportion of the heat of said gases is given up to the apparatus. A vertically oriented downwardly directed baffle separates the combustion chambers. Primary and secondary air paths supply air to the primary and secondary combustion chambers respectively. Each of the supply conduits is pre-heated and the secondary air supply provides oxygen substantially evenly around an opening at a bottom portion of the baffle to increase the efficiency of secondary combustion. The apparatus is further provided with a self-clearing top smoke chamber having a pivotable top cover. A rotatable flue collar is provided for either a horizontal or a vertical connection to the exit flue.

21 Claims, 9 Drawing Figures

HEATING APPARATUS HAVING IMPROVED COMBUSTION

This is a continuation of application Ser. No. 837,608, filed Sept. 28, 1977, now abandoned.

The invention relates generally to heating apparatus and in particular to a wood-burning heating apparatus having a high heat conversion efficiency.

BACKGROUND OF THE INVENTION

Wood-burning stoves have been available for centuries. Perhaps the most well-known wood-burning stove is the Franklin stove which, while being practical for its time, burned wood inefficiently. That stove, like most cast iron stoves available today, provides for updraft combustion, such as is found in a fireplace and in which the volatile gases (volatiles) which are driven off as the wood burns are generally left unburned. The unburned volatiles remain for two reasons, first because the gases, by the time they have left the wood, are generally too cool for secondary combustion and second, because oxygen that is admitted to the stove or fireplace is usually consumed by the coals at the base of the fire mass, causing the gases to rise through an oxygen-deficient atmosphere. The loss of the volatile gases is a serious problem, because they represent approximately half of the total heat value of the wood. It is as though one were to run an open line of natural gas up a chimney without bothering to ignite it first. In addition, the volatile gases given off from the wood without being ignited may also condense on the cool sides of long metal flue pipes and drip out as creosote which may sometimes be inadvertently and dangerously burned, in their sold creosote form, as a chimney fire.

One effective method and apparatus for reducing the volatiles is found in a horizontal combustion heating apparatus wherein the flames move horizontally in the primary combustion zone. This is radically different from typical updraft combustion and is the basis of the more efficient operation of a stove manufactured by Vermont Castings, Inc., the assignee of this invention, which has been sold since at least the first quarter of 1976 under the trade name "DEFIANT". The DEFIANT parlor stove aids the burning of the volatile gases in several ways. First, by using horizontal combustion, the gases are forced to pass close to the hot coals which maintain sufficiently high temperatures to ignite them. In addition, a manually controlled secondary air source, which is segregated from primary air source, provides air which is ducted down a tube integral with the heated fireback of the primary combustion chamber, which is heated by the hottest part of the fire on two sides, and this channel preheats the air to maintain the air at the elevated temperatures required for combustion. Thus, oxygen from the secondary source is led into the secondary combustion chamber through numerous air ports to mix with the combustible gases and to provide secondary combustion. In the "DEFIANT", the secondary source of air is provided in the secondary combustion chamber along an outside wall of the chamber, away from the primary combustion chamber.

In addition, behind the fireback which is provided at the back of the primary combustion chamber, a circuitous path is provided by smoke baffles. The circuitous path is comprised of a plurality of smoke passages, which conduct the smoke through the passages back and forth along the back of the apparatus and upwardly toward the exit at the flue collar. Since the heat of the flue gases is considerable, significant heat transfer occurs from the flue gases to the surfaces of the stove, which in turn is given off into the room rather than being lost up the chimney. In addition, the circuitous path aids in maintaining higher temperature in the combustion chamber which aids in burning the volatile gases driven off from the wood. Thus, in the "DEFIANT", a large heat output is available. In addition, the fire is controlled by not only the structure of the apparatus but by a thermostatically controlled input port which supplies the primary air.

Even though, the "DEFIANT" promotes secondary combustion in the secondary combustion chamber, it is still desirable to increase the efficiency of the unit by whatever means are needed. Thus, while the "DEFIANT" has been hailed as a significant advance in the art of building wood-burning stoves, there should always be room for further improvement.

It is therefore a principal object of this invention to provide a heating apparatus having improved secondary combustion. Further objects of the invention are to provide a wood-burning heating apparatus having a top loading capability and a flexible flue connection.

Yet further objects of the invention are to provide a wood-burning apparatus which is reliable, which provides efficient operation, which is capable of long-term operation with a single load of wood, which has a high heat output, and which can be set for reduced heat output during preselected times.

SUMMARY OF THE INVENTION

A wood-burning apparatus according to the invention features a heat-conducting frame member enclosing a primary combustion chamber, a secondary combustion chamber in gaseous communication with the primary combustion chamber, and a baffling arrangement in gaseous communication with the secondary combustion chamber for providing a long internal flame path. A vertically oriented downwardly directed baffle separates the primary and secondary combustion chambers. A portion of the baffle is spaced from a bottom surface of the frame for providing an opening connecting the primary and secondary combustion chambers for providing the gaseous communication therebetween. A primary air supply path provides air for promoting combustion in the primary combustion chamber. A secondary air supply path extends at least along the downwardly directed baffle for providing preheated air to the secondary combustion chamber at said opening. A combustion product exit aperture at a top portion of the frame and in gaseous communication with the baffling arrangement, provides an exit port for the combustion products.

In a preferred aspect of the invention there is featured a pivoting top cover for providing a smokeless loading aperture in the frame top when the top cover is pivoted to an open condition.

In another aspect of the invention there is featured a rotatable flue collar for providing in one position a top exiting heating apparatus and in a second position a rear exiting heating apparatus.

In yet another aspect of the invention, a thermostatically controlled inlet port is provided in the frame for supplying air to the primary and secondary supply paths.

DESCRIPTION OF THE DRAWINGS

Other features, objects, and advantages of the invention will appear from the following description of a preferred embodiment taken together with the drawings, in which.

DESCRIPTION OF A PREFERRED EMBODIMENT

Figure 1:
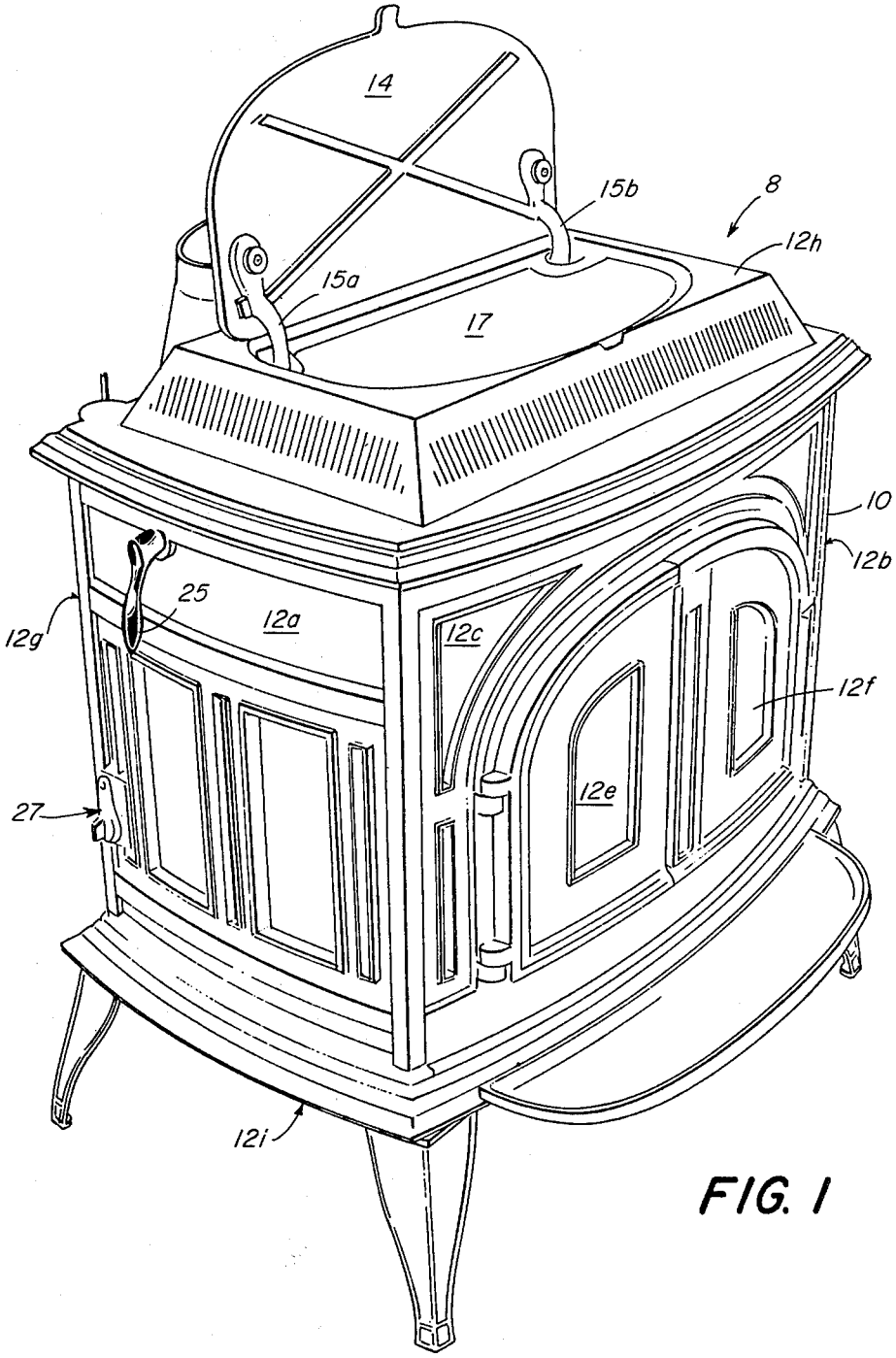
FIG. 1 is a front perspective view of a heating apparatus according to the invention.

Referring to FIG. 1, the wood-burning heating apparatus 8 has an exterior frame member 10 preferably comprised of a heavy-duty cast iron. The sides 12*a*, 12*b*, front 12*c* with doors 12*e*, 12*f*, back 12*g*, top 12*h*, and bottom 12*i* of the frame member are joined to form an integral air tight unit. The front pivoting doors 12*e*, 12*f*, allow the heating apparatus to be opened from the front for both loading of wood and for viewing the fire when the heating apparatus is used as a fireplace. A top cover 14 of the apparatus, has hinges 15*a*, 15*b* which allow it to pivot to an upward position, whereby wood may be loaded into a primary combustion chamber 16 (FIG. 3) through a smokeless loading aperture 17. The aperture size is designed to sweep the opening clear of smoke when the top cover is pivoted to an open condition. Preferably the ratio of aperture cross-sectional area to the flue gas output exit cross-sectional area is about three to one. Thus, even when the stove is in operation, firewood may be reloaded merely by dropping wood into the primary combustion chamber. An asbestos seal around aperture 17 provides an air tight fit between cover 14 and the frame member.

Figure 2:
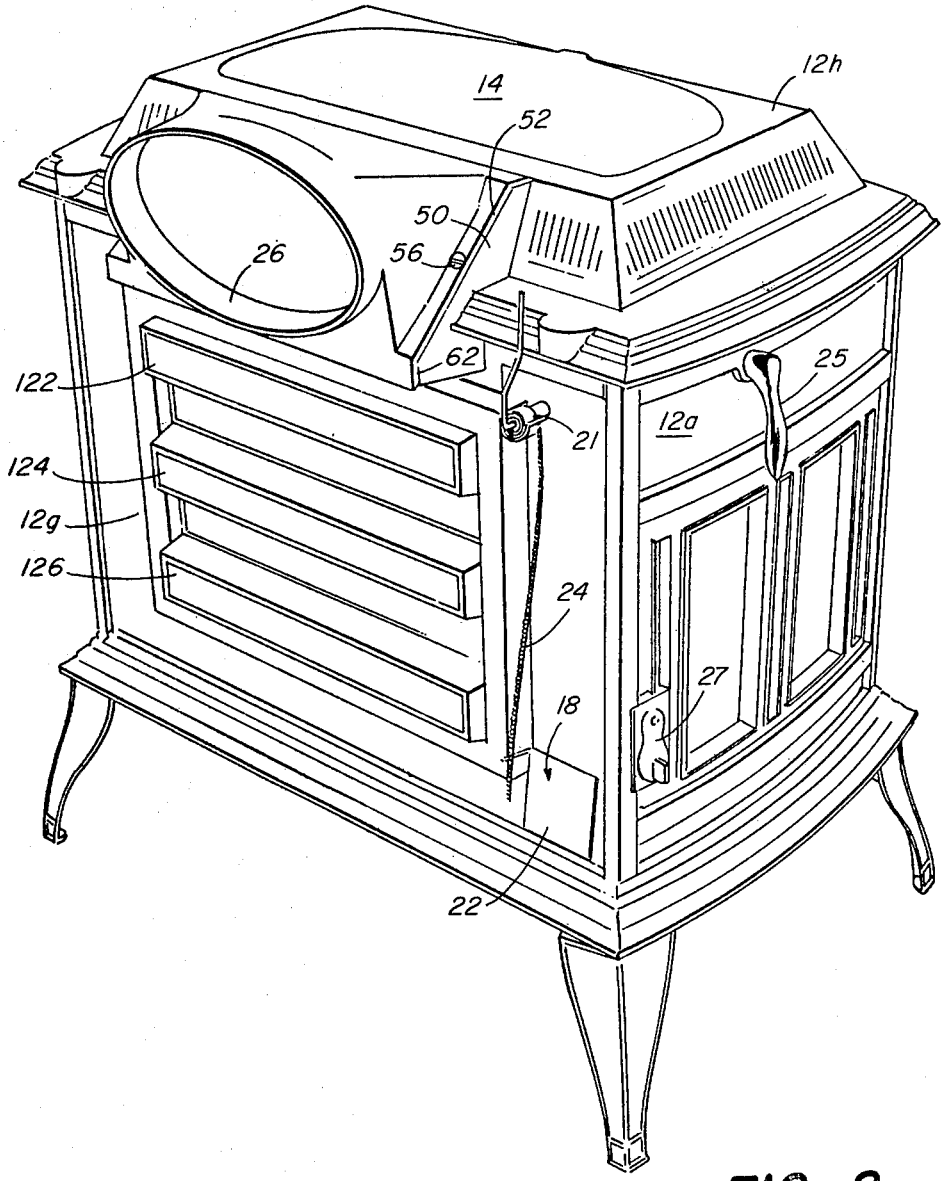
FIG. 2 is a rear perspective view of the heating apparatus of FIG. 1.
Figure 3:
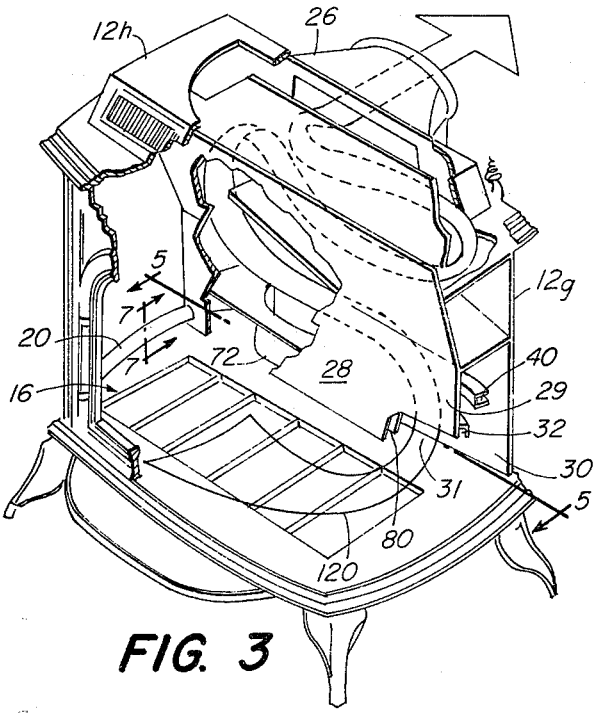
FIG. 3 is a cut-away front perspective view of the heating apparatus according to the invention.

Referring to FIGS. 2 and 3, air is fed to the primary combustion chamber 16 through a primary inlet port 18 and a primary air supply flow path 20 (FIG. 3). Inlet port 18 is thermostatically controlled by a thermostat 21 which operates a damper 22 covering an aperture 23 (FIG. 6) in the back frame member 12*g*. Thermostat 21 is for example an 8" coil of bimetallic material connected to damper 22 by a flexible chain 24. Heating apparatus 8 is also provided with a damper control lever 25, a rotatable flue member 26, and a manually controlled night air inlet port 27 in side member 12*a*.

Referring to FIG. 3, primary air extending through aperture 23 travels through primary air supply path 20 and is heated by the fire which surrounds the tubes. Thus, the primary air is preheated and helps to keep a hotter fire going with less air and wood consumed. The primary combustion chamber is bounded by the substantially vertically oriented downwardly extending fireback baffle 28, the side walls 12*a* and 12*b* of the frame member, the front doors 12*e*, 12*f* and front wall 12*c* of the frame member and the top 12*h* and bottom 12*i* frame member panels.

A right-hand portion 29, of baffle 28 further provides, a partial separation between the primary combustion chamber 16 and a secondary combustion chamber 30. The secondary combustion chamber is connected to and is in gaseous communication with the primary combustion chamber through an opening 31 in baffle 28. A secondary air supply flow path 32 is provided, for the secondary combustion chamber from thermostatically controlled inlet port 18, and comprises an imperforate section 36 (FIG. 5) which extends from the inlet port 18 to substantially the beginning of the secondary combustion chamber and a perforate or apertured conduit 38 which extends within the secondary combustion chamber along a bottom section of baffle 29 around opening 31. The detailed nature of the secondary air supply is described in more detail below.

There is further provided a third air supply path 40 which may be used to provide air from manually controlled inlet 27 to the secondary combustion chamber during night or other selected periods of low heat output operation. Air supply path 40 further provides additional oxygen for secondary combustion in the secondary combustion chamber.

Figure 5:
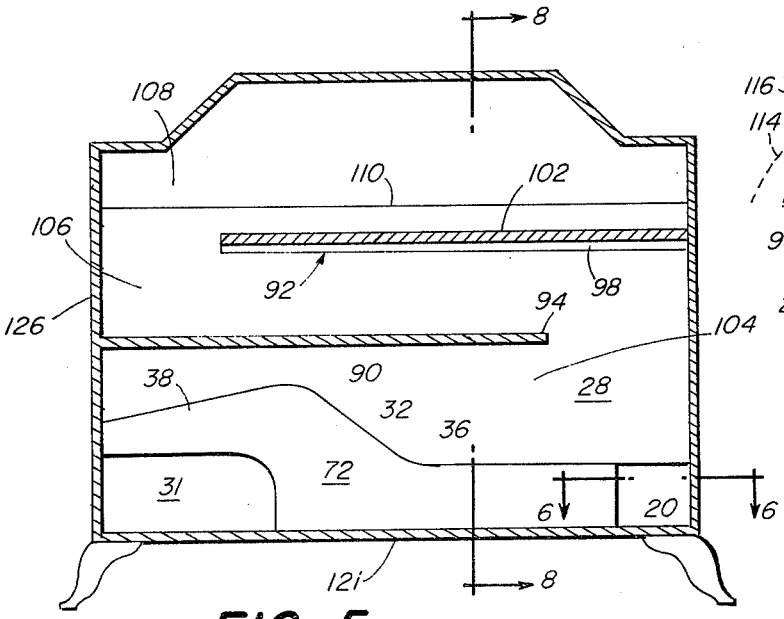
FIG. 5 is a cross-sectional view facing the back of the fireback baffle along lines 5—5 of FIG. 3.

Behind the fireback baffle 28 are a plurality of connecting smoke passages 104, 106, 108 (FIG. 5). These passages direct the spent flue gases from the secondary combustion chamber to the left end of the apparatus, (looking from the front), then into an upper channel or passage 41*b* and back toward the right portion of the stove, and then further up into an uppermost passage 41*c* and back toward the left portion of the stove, where they finally exit through the flue collar 26. The secondary combustion chamber, taken together with the smoke passages, make up the flame path. Since the heat of the flue gas is considerable, and is transferred to the surfaces of the stove as the flue gases traverse the passages, a significant amount of heat is given off to the room rather than being lost up the chimney. In addition, since the passages are adjacent to the primary combustion chamber, higher temperatures are maintained within the fire mass itself, which aids in burning the volatile gaseous products from the burning wood.

Figure 4B:
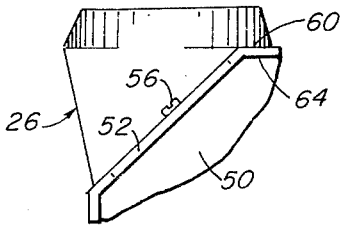
FIG. 4B is a cross-sectional schematic view of the rotatable flue collar in the top exit position according to the invention.
Figure 4A:
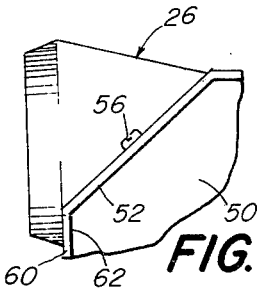
FIG. 4A is a cross-sectional schematic view of the rotatable flue collar in the rear exit position according to the invention.

Referring to FIGS. 4A and 4B, flue collar 26 is preferably rotatable to allow operation of the apparatus with either a horizontal exit (FIG. 4A) or a vertical exit (FIG. 4B) position. The flue collar is attached to an inclined back portion 50 which is securely positioned on the back and top frame portions of the apparatus. The flue collar is secured to the inclined surface 52 of the back portion by two flue collar bolts 56 (only one of which is shown in the figures). The two bolts are secured on opposed sides of the flue collar.

Referring to FIG. 4A, an extended portion 60 of the flue collar contacts vertically oriented section 62 of the back portion 50 for additional orientation and alignment support. By removing the flue collar bolts, (located on opposite sides of the flue), and rotating the flue collar 180°, the orientation shown in FIG. 4B may be obtained. This orientation provides the top exiting stove and is maintained by replacing the bolts 56. The extended portion 60 of the flue collar 26 is now positioned against the horizontally oriented section 64 of portion 50.

Figure 6:
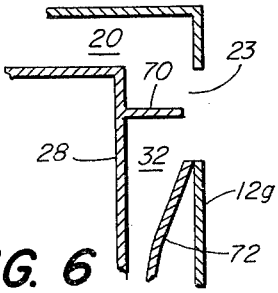
FIG. 6 is a cross-sectional view taken along lines 6—6 of FIG. 5.

Referring to FIGS. 5 and 6, the thermostatically controlled inlet port 18 preferably supplies air for both the primary and secondary air flow paths. Ambient air enters through aperture 23 in frame back wall 12*g* and is almost immediately divided between the primary and secondary flow paths by a dividing plate member 70. That portion of the incoming air which passes into the secondary flow path 32 is directed along the fireback baffle 28 and is constrained to follow a path adjacent to the fireback baffle by an enclosing member 72. Enclosing member 72 not only directs the secondary air flow toward opening 31 in baffle 28, but, in order to provide a substantially uniform flow of air into opening 31, the cross-sectional area of the supply path defined by enclosing member 72 in combination with baffle 28 increases substantially as the path approaches the opening, as shown in FIG. 5. This provides the necessary volume distribution of the flow to promote substantially uniform air flow in the opening. At the opening 31, the enclosing member 72 ends in a substantially spaced apart parallel alignment with the baffle 28, for example at 80 (FIG. 3) so that the flow of secondary air is substantially unimpeded into the secondary chamber at opening 31. The secondary air supplied at opening 31 is also preheated due to its proximity with baffle 28 so that the efficiency of the secondary combustion chamber is increased.

Figure 7:
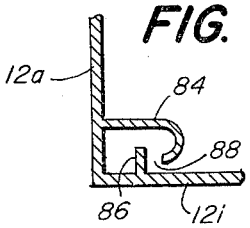
FIG. 7 is a cross-sectional view taken along lines 7—7 of FIG. 3.

That portion of the ambient air passing through aperture 23 which follows primary flow path 20, passes through the baffle 28 near the lower base of the baffle (FIG. 3) and is supplied to the primary combustion chamber along an open ended slotted conduit which extends from baffle 28, along side wall 12*a*, and for approximately one-fifth the distance along the bottom of front wall 12*c*. The slotted conduit has a cross-sectional area which is substantially constant (FIG. 7). The conduit comprises a horizontally extending J-shaped element 84 and a vertically upwardly extending cast member 86 which together define the elongated slot 88. Primary air is thus provided to promote a uniform flow of combustion supporting oxygen across the entire depth of the combustion chamber.

Thus the air provided by primary flow path 20 enters the primary combustion chamber along the bottom left-hand surface of the chamber (looking from the front), and traverses the chamber toward the right-hand side panel 12*b*, providing combustion along the entire bottom of the wood supply. Upon reaching the right-hand portion of the apparatus, the air flow is directed toward and through opening 31 and exits through the circuitous flow path provided by the baffle arrangement extending between baffle 28 and rear wall 12*g*.

Figure 8:
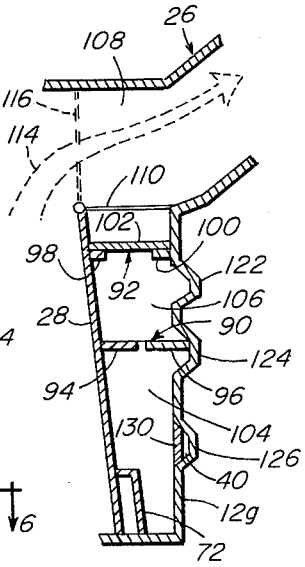
FIG. 8 is a cross-sectional view taken along lines 8—8 of FIG. 5.

Referring to FIGS. 5 and 8, the baffle arrangement for directing the flue gases along the circuitous path through the space between baffle 28 and back wall 12*g* comprises a lower baffle 90 and an upper baffle 92. Lower baffle 90 is comprised of two cast plate members 94 and 96 which meet along their length to form baffle 90 when the fireback baffle 28 is put into position. Baffle 90 extends substantially from side wall 12*b* to a position near side wall 12*a*. Baffle 92 extends above baffle 90 and comprises a pair of tabular cast supporting members 98, 100 which support a baffle plate 102 extending substantially from side wall 12*a* to a position near side wall 12*b*. The flue gases thereby are directed from a first horizontally directed passage 104 to a second horizontally directed passage 106 and then to a third horizontally directed passage 108 from which they exit through flue collar 26.

The heating apparatus is also provided with a damper 110 which enables the apparatus both to be used as a parlor stove and as a fireplace. In the position shown in FIG. 8, the apparatus can be used as a fireplace with the flue gases exiting from the primary combustion chamber along a path generally indicated by arrow 114. This provides updraft combustion. When the damper is closed, that is, placed in a position indicated by dotted line 116, the heating apparatus operates as a stove and the flue gases exit substantially as shown by the arrow 120 (FIG. 3). (When fuel is loaded into the apparatus through top cover member 14, the flue must be in the closed position or otherwise smoke will pour out of the aperture 17 in the top panel 12*h*.)

Referring to FIGS. 2 and 8, back wall member 12*g* has a series of corrugations 122, 124, 126, which protrude outwardly from the plane of back wall member 12*g*. These corrugations provide additional heat radiation surfaces for the heating apparatus for increasing the heat delivery to the surrounding air. In addition, the corrugations provide convenient means for channeling "night air" from the manually controlled inlet port 27 to the secondary combustion chamber through night air flow path 40. Thus, the lowermost corrugation 126 is blocked off by a plate 130 and is used to channel the night air into or at least towards the secondary combustion chamber.

In the preferred embodiment of the invention, the opening 31 has a height of between 3 and 4¼ inches and is preferably 4 inches high. It has been found for the particular apparatus depicted in FIG. 3, that the height of opening 31 is important and a height substantially greater than 4 inches increases the heat output of the apparatus and also its conversion efficiency.

The described apparatus, while designed primarily for wood-burning applications, can also be adapted for coal burning. A basket-shaped container of coal can be inserted through top aperture 17. The basket rests on the bottom 12*i* of the frame and the coal is then burned in substantially the same manner as when the stove is used to burn wood.

There is thus provided a compact wood-burning heating apparatus having an exceedingly high efficiency due both to its secondary combustion chamber and secondary air supply supporting it, as well as to its long flue gas flow path and horizontal combustion. It would be obvious to one skilled in the art to apply the various features of the preferred embodiment to a larger wood-burning heating apparatus such as the "DEFIANT" referred to above, wherein the secondary combustion chamber exists alongside of and not behind the primary combustion chamber.

Other embodiments of the invention, including additions, subtractions, deletions, and other modifications of the preferred embodiment of the invention will be obvious to one skilled in the art and are within the scope of the following claims.

What is claimed is:

1. A wood-burning heating apparatus comprising a heat conducting frame member enclosing a primary combustion chamber, a secondary combustion chamber in gaseous communication with said primary combustion chamber, and a baffling arrangement in gaseous communication with said secondary combustion chamber, for providing a long internal flame path, a vertically oriented, downwardly directed baffle for separating said primary and secondary combustion chambers, a portion of said baffle being spaced from a bottom surface of said frame for providing an opening connecting said primary and secondary combustion chambers adjacent said frame bottom surface for providing said gaseous communication therebetween, a primary air supply path for providing air for promoting combustion in said primary combustion chamber, a secondary air supply path spaced apart from said primary air path and extending at least along said downwardly directed baffle for providing preheated air to said secondary combustion chamber at said opening, a manually controlled night air supply path spaced apart from said primary and secondary supply paths for providing a controlled amount of preheated air from a manually controlled inlet port to said secondary combustion chamber, and a combustion products exit aperture at a top portion of said frame and in gaseous communication with said baffling arrangement for providing an exit port for combustion products.

2. The apparatus of claim 1 further including a thermostatically controlled inlet port in said frame for supplying air to said primary and secondary supply paths.

3. The apparatus of claim 1 further including a pivoting top cover for providing a smokeless loading aperture in said frame top when said top cover is pivoted to an open condition.

4. The apparatus of claim 3 wherein the ratio of the area of the loading aperture to the area of the exit aperture is approximately three to one.

5. The apparatus of claim 3 further including an asbestos sealing member between the top cover and the frame member when the top cover is in a closed condition.

6. The apparatus of claim 1 further including a removable flue collar for providing in one position a top exiting heating apparatus and in a second position a rear exiting heating apparatus, said flue collar having a positioning configuration for mounting against said frame member in only said first and second positions, and means for rigidly mounting said fixed flue collar to said frame member in one of said positions.

7. The apparatus of claim 1 wherein said secondary air supply path comprises a first imperforate conduit section connected to a supply port and a second apertured section positioned substantially around the opening at the bottom of said baffle for supplying air substantially evenly across a substantial portion of said baffle opening.

8. The apparatus of claim 7 wherein said supply path has a variable cross-sectional area, said area being a maximum at approximately the intersection of said imperforate and apertured sections.

9. The apparatus of claim 1 wherein said opening at the bottom of said baffle has a height of between 3 and $4\frac{1}{4}$ inches.

10. The apparatus of claim 9 wherein said opening has a height of approximately 4 inches.

11. The apparatus of claim 1 wherein said frame has a corrugation shaped back panel for providing a larger heat radiation area.

12. The apparatus of claim 1 wherein said baffle is parallel to the long dimension of said primary combustion chamber.

13. The apparatus of claim 12 wherein said primary air path extends and is apertured along a first short side of the primary chamber away from said opening, said opening being bounded on one side by a short side of the frame member which also forms the other short side of the primary combustion chamber, whereby the flow of gas across the primary combustion chamber is substantially from said first short side, parallel to said baffle and then through said baffle opening.

14. The apparatus of claim 1 wherein said primary air path in said primary combustion chamber is defined by a slotted air tube conduit comprising, in cross section, a J-shaped horizontally directed portion extending from a vertical wall of said frame and an upwardly directed vertical portion directed to intersect, if extended, the J-shaped portion.

15. A wood-burning heating apparatus comprising a heat conducting frame member enclosing a primary combustion chamber, a secondary combustion chamber in gaseous communication with said primary combustion chamber, and a baffling arrangement in gaseous communication with said secondary combustion chamber, for providing a long internal flame path, a vertically oriented, downwardly directed baffle for separating said primary and secondary combustion chambers, a portion of said baffle being spaced from a bottom surface of said frame for providing an opening connecting said primary and secondary combustion chambers adjacent said frame bottom surface for providing said gaseous communication therebetween, a primary air supply path for providing air for promoting combustion in said primary combustion chamber, a pivoting top cover for providing a smokeless loading aperture in said frame top when said top cover is pivoted to an open condition, a combustion products exit aperture at a top portion of said frame and in gaseous communication with said baffling arrangement for providing an exit port for combustion products, and said top cover, in a closed position, lying in a plane extending no higher than said combustion products exit aperture.

16. A wood-burning heating apparatus comprising a heat conducting frame member enclosing a primary combustion chamber, a secondary combustion chamber in gaseous communication with said primary combustion chamber, and a baffling arrangement in gaseous communication with said secondary combustion chamber, for providing a long internal flame path, a vertically oriented, downwardly directed baffle for separating said primary and secondary combustion chambers, a portion of said baffle being spaced from a bottom surface of said frame for providing an opening connecting said primary and secondary combustion chambers adjacent said frame bottom surface for providing said gaseous communication therebetween, a primary air supply path for providing air for promoting combustion in said primary combustion chamber, a removable flue collar for providing in one position a top exiting heating apparatus and in a second position a rear exiting heating apparatus, said flue collar having a positioning configuration for mounting against said frame member in only said first and second positions, means for rigidly mounting said fixed flue collar to said frame member in one of said positions, said flue collar being physically removed from said frame when changed from one said position to the other position, and a combustion products exit aperture at a top portion of said frame and in gaseous communication with said baffling arrangement for providing an exit port for combustion products.

17. A wood-burning heating apparatus comprising a heat conducting frame member enclosing a primary combustion chamber, a secondary combustion chamber in gaseous communication with said primary combustion chamber, and a baffling arrangement in gaseous communication with said secondary combustion chamber, for providing a long internal flame path, a vertically oriented, downwardly directed baffle for separating said primary and secondary combustion chambers, a portion of said baffle being spaced from a bottom surface of said frame for providing an opening connecting said primary and secondary combustion chambers adjacent said frame bottom surface for providing said gaseous communication therebetween, a primary air supply path for providing air for promoting combustion in said primary combustion chamber, said primary air path in said primary combustion chamber being defined by a slotted air tube conduit comprising, in cross section, a J-shaped horizontally directed portion extending at least in part from a vertical side wall panel of said frame and an upwardly directed vertical portion extending from a bottom panel of said frame and directed to intersect, if extended, the J-shaped portion, the top of said vertical portion extending above the lowest level of said J-shaped portion, and a combustion products exit aperture at a top portion of said frame and in gaseous communication with said baffling arrangement for providing an exit port for combustion products.

18. A wood-burning heating apparatus comprising a heat conducting frame member enclosing a primary combustion chamber, a secondary combustion chamber in gaseous communication with said primary combustion chamber, and a baffling arrangement in gaseous communication with said secondary combustion chamber, for providing a long internal flame path, a vertically oriented, downwardly directed baffle for separating said primary and secondary combustion chambers, a portion of said baffle being spaced from a bottom surface of said frame for providing an opening connecting said primary and secondary combustion chambers adjacent said frame bottom surface for providing said gaseous communication therebetween, a primary air supply path for providing air for promoting combustion in said primary combustion chamber, said frame having a corrugation shaped back panel for providing a larger heat radiation area, said corrugations being reflected on both the interior and exterior surfaces of said back panel, means for enclosing, on an interior surface of at least one externally projecting corrugation a portion of an air supply path, and a combustion products exit aperture at a top portion of said frame and in gaseous communication with said baffling arrangement for providing an exit port for combustion products.

19. A wood-burning heating apparatus comprising a heat conducting frame member enclosing a primary combustion chamber, a secondary combustion chamber in gaseous communication with said primary combustion chamber, and a baffling arrangement in gaseous communication with said secondary combustion chamber for providing a long internal flame path, a vertically oriented downwardly directed baffle for separating said primary and secondary combustion chambers, a portion of said baffle being spaced from a bottom surface of said frame for providing an opening connecting the primary and secondary combustion chambers adjacent said frame bottom surface for providing said gaseous communication therebetween, a primary air supply path for providing air for promoting combustion in said primary combustion chamber, a secondary air supply path spaced apart from said primary supply path and extending at least along said downwardly directed baffle for providing at said opening preheated air for promoting secondary combustion, a manually controlled night air supply path spaced apart from said primary and secondary paths for providing a controlled amount of preheated air from a manually controlled inlet port to said secondary combustion chamber, said night air supply path extending along a corrugation shaped back panel of said frame, and there being enclosed, for at least a portion of an externally projecting corrugation in said back panel, a pivoting top cover and means for providing a smokeless loading aperture in said frame top when said top cover is pivoted to an open condition, a combustion products exit aperture at a top portion of said frame and in gaseous communication with said baffling arrangement for providing an exit port for combustion products, and a removable flue collar for providing in one position a top exiting heating apparatus and in a second position a rear exiting heating apparatus.

20. A wood-burning heating apparatus comprising a heat conducting frame member enclosing a primary combustion chamber, a secondary combustion chamber in gaseous communication with said primary combustion chamber, and a baffling arrangement in gaseous communication with said secondary combustion chamber for providing a long internal flame path, a vertically oriented, downwardly directed baffle for separating said primary and secondary combustion chambers, a portion of said baffle being spaced from a bottom surface of said frame for providing an opening connecting the primary and secondary combustion chambers adjacent said frame bottom surface for providing said gaseous communication therebetween, a primary air supply path for providing air for promoting combustion in said primary combustion chamber, a secondary air supply path spaced apart from said primary path and extending at least along said downwardly directed baffle for providing preheated air to said secondary combustion chamber at said opening, a manually controlled night air supply path spaced apart from said primary and secondary paths for providing a controlled amount of preheated air from a manually controlled inlet port to said secondary combustion chamber, a combustion products exit aperture at a top portion of said frame and in gaseous communication with said baffling arrangement for providing an exit port for combustion products, a removable flue collar for providing in one position a top exiting heating apparatus and in a second position a rear exiting heating apparatus, said flue collar having a positioning configuration for mounting against said frame member in only said first and second positions, means for rigidly mounting said fixed flue collar to said frame member in one of said positions, wherein said flue collar must be removed from said frame to change the mounting from one position to said other position, said primary air path in said primary combustion chamber being defined by a slotted air tube conduit comprising, in cross section, a J-shaped horizontally directed portion extending at least in part from a vertical side wall panel of said frame and an upwardly directed vertical portion extending from a bottom panel of said frame and directed to intersect, if extended, the J-shaped portion, the top of said vertical portion extending above the lowest level of said J-shaped portion, and said opening extending parallel to a damper element pivot axis.

21. A wood-burning heating apparatus comprising a heat conducting frame member enclosing a primary combustion chamber, a secondary combustion chamber in gaseous communication with said primary combustion chamber, and a baffling arrangement in gaseous communication with said secondary combustion chamber for providing a long internal flame path, a vertically oriented, downwardly directed baffle for separating said primary and secondary combustion chambers, a portion of said baffle being spaced from a bottom surface of said frame for providing an opening connecting the primary and secondary combustion chambers adjacent said frame bottom surface for providing said gaseous communication therebetween, a primary air supply path for providing air for promoting combustion in said primary combustion chamber, a secondary air supply path spaced apart from said primary path and extending at least along said downwardly directed baffle for providing preheated air to said secondary combustion chamber at said opening, a manually controlled night air supply path spaced apart from said primary and secondary paths for providing a controlled amount of preheated air from a manually controlled inlet port to said secondary combustion chamber, a combustion products exit aperture at a top portion of said frame and in gaseous communication with said baffling arrangement for providing an exit port for combustion products, a removable flue collar for providing in one position a top exiting heating apparatus and in a second position a rear exiting heating apparatus, said flue collar having a positioning configuration for mounting against said frame member in only said first and second positions, and means for rigidly mounting said fixed flue collar to said frame member in one of said positions, wherein said flue collar must be removed from said frame to change the mounting from one position to said other position, and p1 said downwardly directed baffle and a rear panel of said frame member having means cast integral therewith for defining said long flame path as at least two gaseously connected, substantially horizontally directed gas flow paths, said horizontal paths extending substantially parallel to said opening.

* * * * *